US011571034B2

(12) United States Patent
Stuart-Richards

(10) Patent No.: US 11,571,034 B2
(45) Date of Patent: Feb. 7, 2023

(54) HANDHELD WEAVING TOOL

(71) Applicant: Shermaine Stuart-Richards, Roseland, NJ (US)

(72) Inventor: Shermaine Stuart-Richards, Roseland, NJ (US)

( * ) Notice: Subject to any disclaimer, the term of this patent is extended or adjusted under 35 U.S.C. 154(b) by 175 days.

(21) Appl. No.: 16/838,469

(22) Filed: Apr. 2, 2020

(65) Prior Publication Data

US 2020/0315275 A1 Oct. 8, 2020

Related U.S. Application Data

(60) Provisional application No. 62/828,155, filed on Apr. 2, 2019.

(51) Int. Cl.
*A41G 5/00* (2006.01)

(52) U.S. Cl.
CPC ..... *A41G 5/0086* (2013.01)

(58) Field of Classification Search
CPC ..... A41G 3/0066; A41G 3/0075; A45D 2002/008; A45D 2002/007; A45D 2002/006; A45D 2002/005; A45D 2002/003; A45D 2/00; A45D 6/02; A45D 6/04; A45D 2007/004; A45D 2007/008; A45D 97/00
USPC ..... 132/212, 271, 210, 200, 201; 289/17
See application file for complete search history.

(56) References Cited

U.S. PATENT DOCUMENTS 7,124,918 B2 * 10/2006 Rascoe ..... D04D 1/04 223/48
10,779,595 B1 * 9/2020 Hurst ..... A41G 5/0086

* cited by examiner

*Primary Examiner* — Cris L. Rodriguez
*Assistant Examiner* — Sydney J Pulvidente
(74) *Attorney, Agent, or Firm* — Boudwin Intellectual Property; Daniel Boudwin

(57) ABSTRACT

A handheld weaving tool is provided, the tool including a housing having a first end opposite a second end and a sidewall extending therebetween defining an interior volume. The second end comprises at least one aperture therethrough. A needle is disposed within the housing and can selectively move between an extended position and a retracted position, wherein an extended position, the needle extends through the aperture, and wherein a retracted position, the needle is disposed entirely within the housing. An opening is disposed in the first end, wherein the opening is dimensioned to receive a thread therethrough, such that the thread is operably connected to the needle. A motor is disposed within the housing and can reciprocally move the needle between the extended position and the retracted position. A control is disposed on the housing and activates the motor when actuated.

18 Claims, 4 Drawing Sheets

HANDHELD WEAVING TOOL

CROSS REFERENCE TO RELATED APPLICATIONS

This application claims the benefit of U.S. Provisional Application No. 62/828,155 filed on Apr. 2, 2019. The above identified patent application is herein incorporated by reference in its entirety to provide continuity of disclosure.

BACKGROUND OF THE INVENTION

The present invention relates to weaving tools. More particularly, the present invention pertains to motor operated weaving tools configured to sew weaves into a user's hair.

Many individuals utilize hair weaves to style their hair in specific ways, or to fill in otherwise thinning hair. However, placing a hair weave is often a difficult and time-consuming process. Typically, the hair must first be tightly braided into cornrows or the like, which then serve as an anchor for receiving a thread or weft to attach the hair weave or extension. Additionally, wig caps are utilized to further provide an anchor. Often, it can be difficult to simultaneously hold the extension to be attached to the individual's hair as well as the needle used to sew the extension to the individual's hair. Furthermore, personally attaching an extension or hair weave to yourself is quite difficult due to the inability to see the top of the head. In order to address these issues, many individuals rely on professionals to attach extensions and weaves, which can become very expensive very quickly. Therefore, a device that allows a user to easily sew an extension or hair weave to their hair is desired.

In light of the devices disclosed in the known art, it is submitted that the present invention substantially diverges in design elements from the known art and consequently it is clear that there is a need in the art for an improvement to existing weaving tools. In this regard, the instant invention substantially fulfills these needs.

SUMMARY OF THE INVENTION

In view of the foregoing disadvantages inherent in the known types of weaving tools now present in the known art, the present invention provides a handheld weaving tool wherein the same can be utilized for providing convenience for the user when efficiently applying a weave to a user's hair.

The present system comprises a housing having a first end opposite a second end and a sidewall extending therebetween, defining an interior volume. The second end comprises at least one aperture therethrough. A needle is disposed within the housing configured to selectively move between an extended position and a retracted position, wherein the extended position, the needle extends through the aperture, and wherein a retracted position, the needle is disposed entirely within the housing. An opening is disposed in the first end, the opening configured to receive a thread therethrough, such that the thread is operably connected to the needle. A motor disposed within the housing, the motor configured to reciprocally move the needle between the extended position and the retracted position when actuated. A control is disposed on the housing and configured to activate the motor when actuated. In some embodiments, the housing further comprises a handle extending orthogonally therefrom. In some embodiments, the needle comprises an arcuate shape.

In another embodiment, a compartment is disposed within the first end of the housing, wherein the compartment is configured to removably secure a spool of thread therein, such that the thread about the spool of thread is configured to operably connect to the needle. In other embodiments, the aperture is disposed through the sidewall of the housing adjacent to the second end, such that the needle extends orthogonally therethrough, thereby minimizing the risk of contact with a user's scalp. In some embodiments, the second end comprises a planar surface, whereas in alternate embodiments, the second end comprises a curved surface, such that the second end is configured to contour to a user's scalp.

In other embodiments, a power source is disposed within the housing, wherein the power source is operably connected to the motor. In another embodiment, a cord is electrically connected to the motor, wherein the cord is configured to electrically connect the motor to an external power source. In this manner, the handheld weaving tool can be used in both a portable and stationary configuration. In some embodiments, the control is variable, such that a speed of the motor is proportional to a pressure applied to the control. In another embodiment, the housing further comprises an ergonomic grip thereon, such that a user's comfort and control of the housing is maximized during use.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
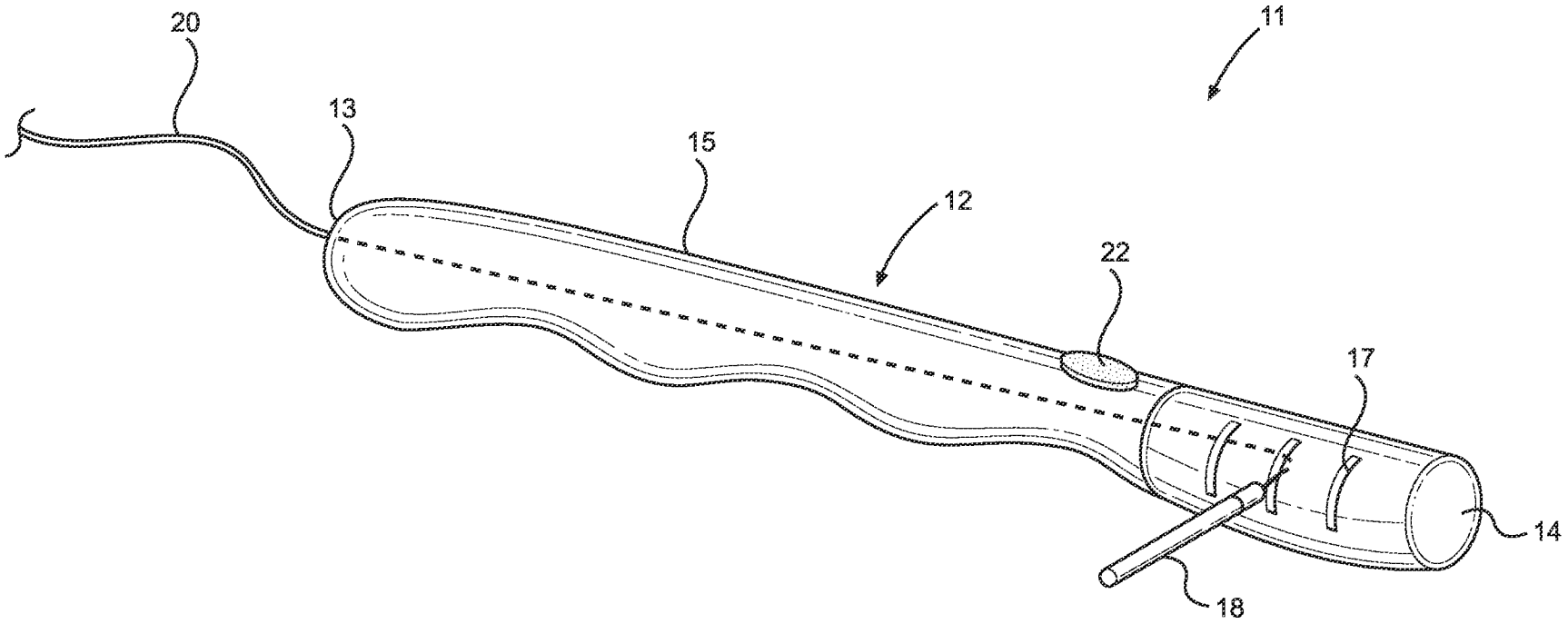
FIG. 1A shows a perspective view of an embodiment of the handheld weaving tool.

Reference is made herein to the attached drawings. Like reference numerals are used throughout the drawings to depict like or similar elements of the handheld weaving tool. The figures are intended for representative purposes only and should not be considered to be limiting in any respect.

Figure 1B:
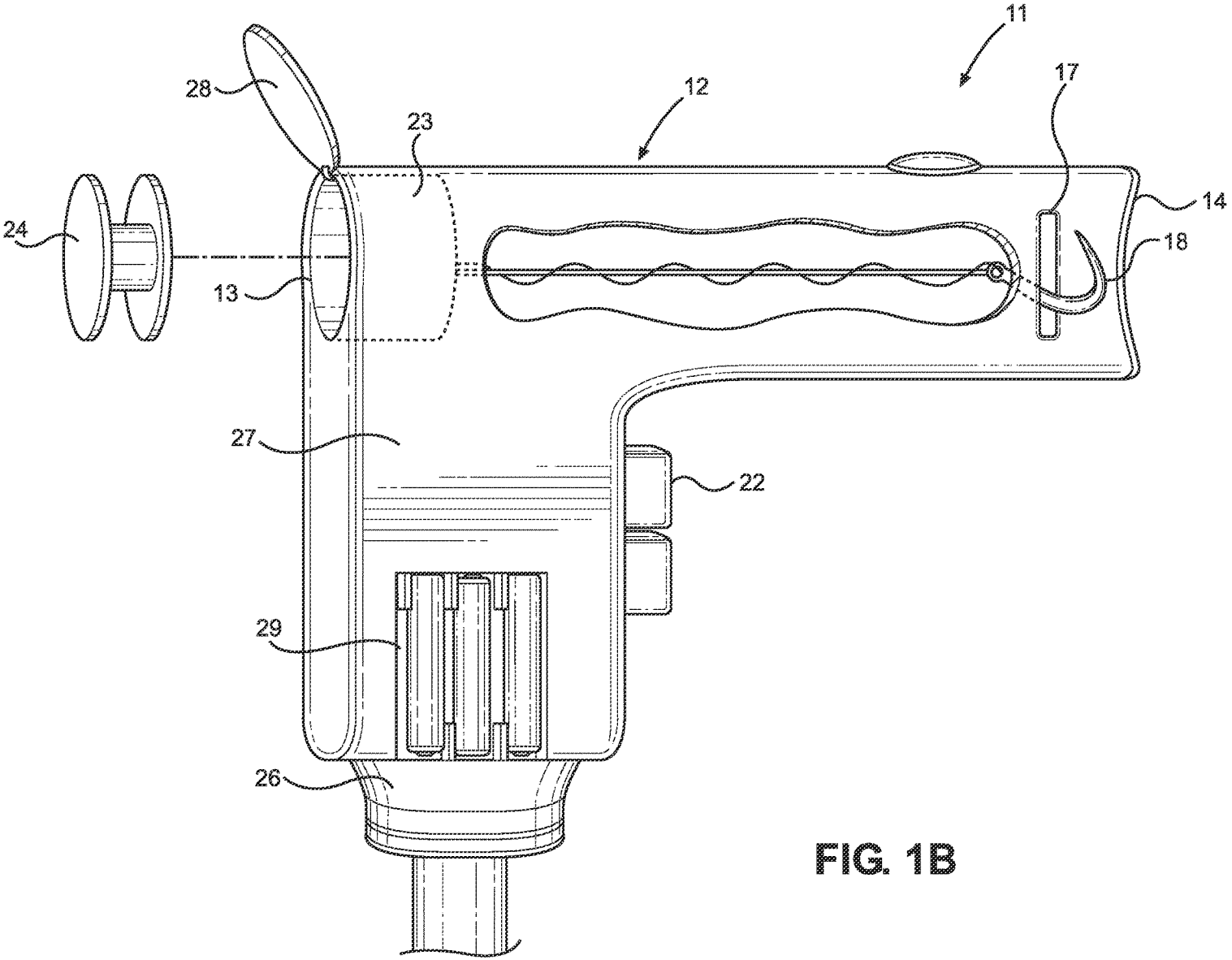
FIG. 1B shows a perspective view of an alternate embodiment of the handheld weaving tool.

Referring now to FIGS. 1A and 1B, there is shown a perspective view of an embodiment of the handheld weaving tool and a perspective view of an alternate embodiment of the handheld weaving tool, respectively. The handheld weaving tool 11 comprises a housing 12 having a first end 13 opposite a second end 14, wherein a sidewall 15 extends therebetween defining an interior volume. In the shown embodiment of FIG. 1A, the housing 12 comprises an elongated cylindrical housing 12 configured to provide a reduced form factor for increased portability and storage. Alternatively, in the illustrated embodiment of FIG. 1B, the housing 12 comprises a pistol shaped housing 12 having a handle 27 extending orthogonally from therefrom. In this manner, the user can grip the handle 27 and orient the housing 12 in a desired position. In the illustrated embodiment, the housing 12 comprises an ergonomic gripping surface thereon, wherein the ergonomic grip comprises a plurality of depressions across the housing 12 configured to receive a finger of the user therein. In embodiments with a handle 27, the handle 27 can optionally comprise the ergonomic grip described above, such that either housing 12 configuration provides increased gripping capabilities and comfort.

The first end 13 comprises an opening therein, wherein the opening is configured to receive a thread 20 therethrough, such that the thread 20 extends through the interior volume of the housing 12 towards the second end 14. The thread 20 is contemplated to include a variety of materials, such as cotton, nylon, and thread mimicking human hair. In the illustrated embodiment of FIG. 1A, the thread 20 is dispensed from an external source, such as an external spool or skein. The thread 20 can be operably connected to a needle 18 disposed within the housing 12 at the second end 14, such that the needle 18 can sew the thread 20 into hair or other material. In the illustrated embodiment of FIG. 1B, the housing 12 further comprises a compartment 23 disposed within the first end 13, wherein the compartment 23 is configured to removably secure a spool 24 of thread 20 therein. In this manner, the thread 20 can be fed through the housing 12 via the spool 24, such that the user can utilize the handheld weaving tool 11 in a portable fashion. Further, in the shown embodiment of the FIG. 1B, the first end 13 further comprises a door 28 hingedly affixed thereto, wherein the door 28 is selectively movable between an open position and a closed position, wherein the closed position, the door 28 encloses the compartment 23 such that the spool 24 is retained therein.

Figure 3:
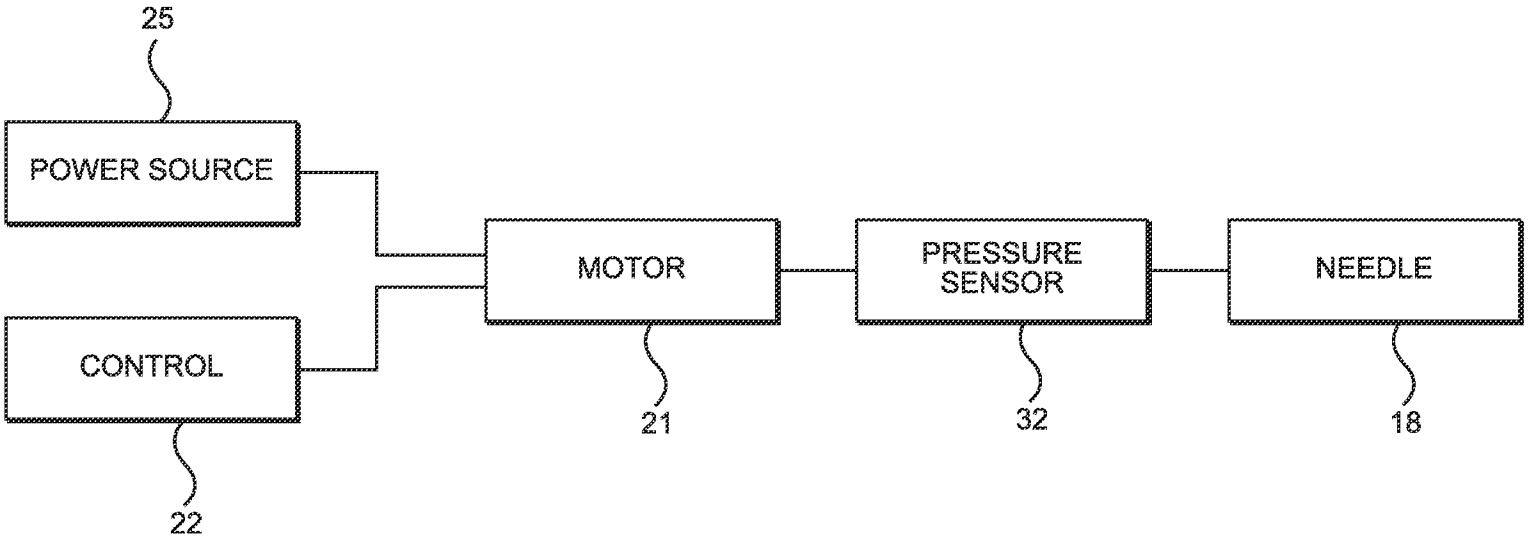
FIG. 3 shows a schematic view of an embodiment of the handheld weaving tool.

The second end 14 of the housing 12 further comprises at least one aperture 17 therethrough. The needle 18 is configured to extend through the aperture 17 between a retracted position and an extended position in a reciprocating motion driven by a motor (as shown in FIG. 3, 21), allowing the thread 20 to be sewn into a desired material, such as through the hair of a user. When in the extended position, the needle 18 extends through the aperture 17, and when in the retracted position, the needle 18 is disposed entirely within the housing 12. In the shown embodiment of FIG. 1A, a plurality of apertures 17 are disposed through the second end 14. In this way, the user can adjust a relative height of the needle 18 when the second end 14 is placed flush against a scalp or other sewing surface by selecting which aperture 17 of the plurality of apertures 17 the needle 18 extends through. In the illustrated embodiment of FIG. 1B, the needle 18 comprises a curved shape, similar to existing needles used in hair weaving applications, in order to provide a similar experience. In such embodiments, the needle 18 travels in an arcuate path when actuated between the extended position and the retracted position.

In the illustrated embodiment of FIG. 1A, the second end 14 comprises a planar surface configured to rest flush against a sewing surface, such as a user's scalp. In this manner, the needle 18 is prevented from contacting the user during use, as the needle 18 extends orthogonally from the housing 12 via an aperture 17 disposed on the sidewall 15 at the second end 14. In some embodiments, the second end 14 comprises a curved surface, allowing the second end 14 to contour to a rounded sewing surface, such as the head of the user. In another embodiment, the needle 18 is configured to rotate about the housing 12 when driven by the motor, such that the needle 18 exits through a first aperture 17 and reenters the housing 12 through a second aperture 17 disposed opposite the first aperture 17. In other embodiments, a pair of needles 18 are disposed within the housing 12, wherein each needle 18 extends from the housing 12 in opposite directions, allowing a user to simultaneously sew two adjacent rows of hair.

A control 22 is disposed on the housing 12, wherein the control 22 is operably connected to the motor, such that the motor is activated when the control 22 is actuated. In the shown embodiment of FIG. 1B, the control 22 is disposed on the handle 27, such that the control 22 is within easy reach of the gripping surface. In some embodiments, the control 22 comprises a variable speed control 22, such that the user can control the rate at which the needle 18 reciprocates. In such embodiments, the variable speed control 22 is pressure sensitive, such that the rate of needle 18 reciprocation is proportional to the pressure applied to the control 22. In this way, the user can select a sewing speed the user is comfortable with by varying pressure applied to the control 22. In some embodiments, multiple controls 22 are disposed on the housing 12, wherein each control 22 corresponds to a desired function, such as reversing the needle 18, altering the sewing pattern used, and the like.

In the illustrated embodiments, a power source (as shown in FIG. 3, 25) is electrically connected to the motor. The power source can comprise a battery, such that the user can utilize the handheld weaving tool 11 portably, an external power source connected to the housing 12 via a cord 26, or a combination of the above, allowing the user to selectively determine which power source is desirable. In embodiments with a battery, a battery compartment 29 is disposed within the housing 12, or as shown in the embodiment of FIG. 1B on the handle 27. When electrically connected to an external power source via the cord 26, the external power source can additionally provide power to the battery, such that the user can charge the battery for future portable use.

Figure 2:
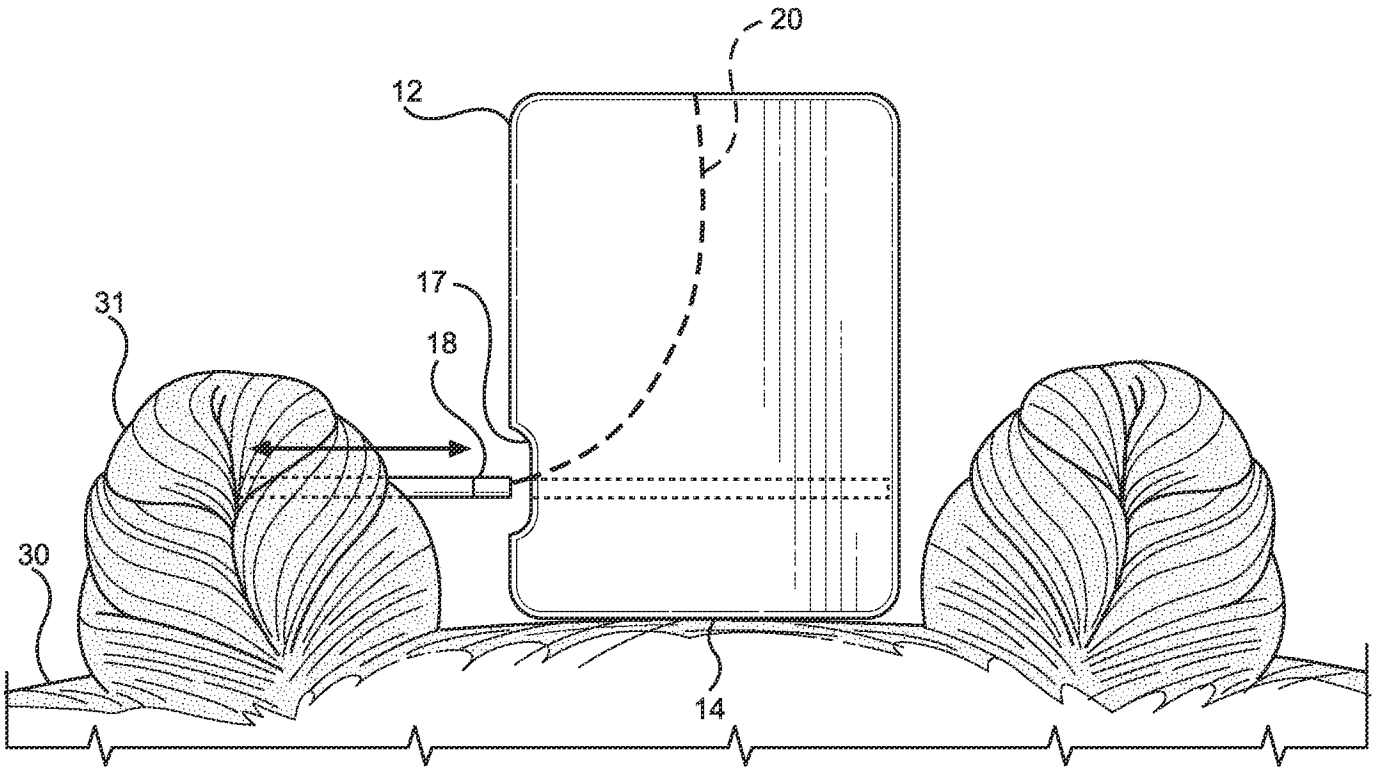
FIG. 2 shows a close-up view of an embodiment of the handheld weaving tool in use.

Referring now to FIG. 2, there is shown a close-up view of an embodiment of the handheld weaving tool in use. In one use, the user prepares the sewing surface, such as the scalp 30 for weaving. In a hair weaving application, the hair is prepared by braiding into a series of cornrows 31 disposed across the scalp 30. The user can then secure a wig cap to the scalp 30 over the cornrows 31. The housing 12 is then placed against the scalp 30 such that the second end 14 rests flush thereagainst. In this way, the needle 18 extends orthogonally through the aperture 17 such that the needle 18 cannot contact the scalp 30 of the user when the second end 14 is placed flush against the scalp 30. The apertures 17 is then oriented towards the cornrow 31, such that the needle 18 extends therethrough when moving to the extended position. The thread 20 affixed to the needle 18 extends through the cornrow 31 and the wig cap, such that thread 20 engaged within the braided hair of the cornrow 31, thereby anchoring the wig cap to the user's head. Once the wig cap is secured the user can secure a hair weave to the anchored wig cap and cornrows 31 via a similar process. As shown, the needle 18 is disposed entirely within the housing 12 when in the retracted position to prevent inadvertent contact therewith.

Referring now to FIG. 3, there is shown a schematic view of an embodiment of the handheld weaving tool. In the shown embodiment, the power source 25 is operably connected to the motor 21. The control 22 is further connected to the motor 21, such that when the control 22 is actuated, the motor 21 is activated to drive the needle 18 in a reciprocating motion. In the shown embodiment, the device further comprises a pressure sensor 32 therein, wherein the pressure sensor 32 is configured to detect a pressure applied to the needle 18 during use. If the detected pressure exceeds a threshold pressure, the motor 21 is interrupted, thereby stopping reciprocation of the needle 18. The threshold pressure can be configured to a range of pressures between that required to pierce braided hair and a wig cap and that required to pierce skin or other dense materials. In this manner, the needle 18 is prevented from piercing an undesired material or surface, including the skin or scalp of the user.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handheld weaving tool, comprising:

a housing having a first end opposite a second end, an upper sidewall, a lower sidewall, and a pair of lateral sidewalls defining an interior volume therebetween;

wherein an aperture is disposed through a lateral sidewall of the pair of lateral sidewalls adjacent to the second end;

a needle disposed within the housing configured to selectively move between an extended position and a retracted position;

wherein the extended position, the needle extends through the aperture to exit the housing, and wherein the retracted position, the needle is disposed entirely within the housing;

an opening disposed in the first end, the opening configured to receive a thread therethrough, such that the thread is operably connected to the needle;

a motor disposed within the housing, the motor configured to reciprocally move the needle between the extended position and the retracted position when actuated;

a control disposed on the housing and configured to activate the motor when actuated.

2. The handheld weaving tool of claim 1, wherein the needle comprises an arcuate shape.

3. The handheld weaving tool of claim 1, further comprising a compartment disposed within the first end, wherein the compartment is configured to receive a spool of thread therein, such that the thread of the spool of thread is operably connected to the needle.

4. The handheld weaving tool of claim 1, wherein the second end comprises a planar surface configured to rest flush against a scalp of the user.

5. The handheld weaving tool of claim 1, wherein the second end comprises a curved surface configured to contour to a scalp of a user, wherein the curved surface is concave defining a central depression between an upper side and a lower side of the second end.

6. The handheld weaving tool of claim 1, further comprising a power source disposed within the housing, wherein the power source is operably connected to the motor.

7. The handheld weaving tool of claim 1, further comprising a cord electrically connected to the motor, wherein the cord is configured to electrically connect the motor to an external power source.

8. The handheld weaving tool of claim 1, wherein the control comprises a variable speed control configured to adjust a speed of the motor proportional to a pressure applied to the control.

9. The handheld weaving tool of claim 1, wherein the housing comprises an elongated cylindrical housing.

10. The handheld weaving tool of claim 1, wherein the housing further comprises an ergonomic grip thereon.

11. A handheld weaving tool, comprising:

a housing having a first end opposite a second end, an upper sidewall, a lower sidewall, and a pair of lateral sidewalls defining an interior volume therebetween;

wherein the housing further comprises a handle extending orthogonally from the lower sidewall;

wherein an aperture is disposed through a lateral sidewall of the pair of lateral sidewalls adjacent to the second end;

a needle disposed within the housing configured to selectively move between an extended position and a retracted position;

wherein the extended position, the needle extends through the aperture to exit the housing, and wherein the retracted position, the needle is disposed entirely within the housing;

an opening disposed in the first end, the opening configured to receive a thread therethrough, such that the thread is operably connected to the needle;

a motor disposed within the housing, the motor configured to reciprocally move the needle between the extended position and the retracted position when actuated;

a power source disposed within the housing, wherein the power source is operably connected to the motor;

a control disposed on the housing and configured to activate the motor when actuated.

12. The handheld weaving tool of claim 11, wherein the needle comprises an arcuate shape.

13. The handheld weaving tool of claim 11, further comprising a compartment disposed within the first end, wherein the compartment is configured to receive a spool of thread therein, such that the thread of the spool of thread is operably connected to the needle.

14. The handheld weaving tool of claim 11, wherein the second end comprises a planar surface configured to rest flush against a scalp of the user.

15. The handheld weaving tool of claim 11, wherein the second end comprises a curved surface configured to contour to a scalp of a user, wherein the curved surface is concave defining a central depression between an upper side and a lower side of the second end.

16. The handheld weaving tool of claim 11, further comprising a cord electrically connected to the motor, wherein the cord is configured to electrically connect the motor to an external power source.

17. The handheld weaving tool of claim 11, wherein the control comprises a variable speed control configured to adjust a speed of the motor proportional to a pressure applied to the control.

18. The handheld weaving tool of claim 1, wherein the housing further comprises an ergonomic grip thereon.

* * * * *